US005101627A

United States Patent [19]

Fujii et al.

[11] Patent Number: 5,101,627

[45] Date of Patent: Apr. 7, 1992

[54] ADJUSTABLE FLOW-COMBINING RESTRICTOR FOR HYDRAULIC EXCAVATOR DUAL PUMP CIRCUIT

[75] Inventors: Kazuhiko Fujii; Wataru Kubomoto; Hiroshi Shimokakiuchi; Sumio Kouchi, all of Hiroshima, Japan

[73] Assignee: Kabushiki Kaisha Kobe Seiko Sho, Kobe, Japan

[21] Appl. No.: 455,148

[22] Filed: Dec. 22, 1989

[30] Foreign Application Priority Data

Jan. 31, 1989 [JP] Japan ..... 1-23470

[51] Int. Cl.[5] ..... F04B 23/04

[52] U.S. Cl. ..... 60/429; 60/486; 91/532

[58] Field of Search ..... 91/516, 530, 532, 510; 60/422, 427, 429, 486

[56] References Cited

U.S. PATENT DOCUMENTS

| | | | |
|---|---|---|---|
| 3,704,800 | 12/1972 | Redelman | 91/532 X |
| 3,972,185 | 8/1976 | Medina | 60/421 |
| 3,987,704 | 10/1976 | Johnson | 60/486 X |
| 3,994,133 | 11/1976 | Pfeil et al. | 91/516 X |
| 3,998,053 | 12/1976 | Johnson | 60/486 X |
| 4,070,857 | 1/1978 | Wible | 60/422 |
| 4,112,821 | 9/1978 | Bianchetta | 60/486 X |
| 4,121,501 | 10/1978 | Finley | 60/486 X |
| 4,142,445 | 3/1979 | Lohbauer | 91/6 |
| 4,210,061 | 7/1980 | Bianchetta | 60/486 X |
| 4,614,475 | 9/1986 | Tamura et al. | 91/530 X |
| 4,875,337 | 10/1989 | Sugiyama et al. | 60/427 X |

FOREIGN PATENT DOCUMENTS

| | | |
|---|---|---|
| 0277602 | 3/1989 | European Pat. Off. . |
| 3221160 | 12/1983 | Fed. Rep. of Germany . |
| 209881 | 5/1984 | Fed. Rep. of Germany . |
| 3406228 | 8/1985 | Fed. Rep. of Germany . |

OTHER PUBLICATIONS

Oelhydraulik & Pneumatik, vol. 30, #9, 1986, pp. 644–654, Mainz, DE; W. Klotzbuecher, "Auslegung von Hydrauliksystemen nach Energetischen Gesichtspunkten unter Beruecksichtigung des Lastkollektivs", p. 652, paragraph 3, FIG. 12.

Maschinenmarkt, vol. 91, No. 24, 1985, pp. 404, 405, Wuerzburg, DE; W. Roehrs et al.: "Den Leistungsgrad Optimieren mit Load-Sensing Ventilen", FIG. 1, middle column, paragraph 2.

*Primary Examiner*—Edward K. Look
*Assistant Examiner*—George Kapsalas
*Attorney, Agent, or Firm*—Oblon, Spivak, McClelland, Maier & Neustadt

[57] ABSTRACT

An oil hydraulic circuit for a hydraulic shovel with which a composite operation can be performed readily and smoothly without special skill in operation of the hydraulic shovel. The oil hydraulic circuit comprises a first actuator which can operate with pressure oil from a predetermined one or both of a pair of hydraulic directional control valve sets, a second actuator which operates only with pressure oil from the other hydraulic directional control valve set, a proportional changing over device interposed intermediately in a pipe line communicating the other hydraulic directional control valve set with a first actuator for adjusting the maximum meter-in opening value to the first actuator in response to a magnitude of a signal received at a signal receiving portion of the proportional changing over device, and a controller for arbitrarily adjusting the signal to be supplied to the signal receiving portion of the proportional changing over device.

3 Claims, 4 Drawing Sheets

ADJUSTABLE FLOW-COMBINING RESTRICTOR FOR HYDRAULIC EXCAVATOR DUAL PUMP CIRCUIT

BACKGROUND OF THE INVENTION

1. Field of the Invention

This invention relates to an oil hydraulic circuit for a hydraulic shovel.

2. Descritpion of the Prior Art

An oil hydraulic circuit of the type wherein flows of discharge pressure oil from a pair of hydraulic pumps are supplied separately to a pair of hydraulic directional control valve sets each composed of a series of hydraulic directional control valves and constituting a parallel circuit, and when a first actuator is to operate at a low speed, pressure oil from a hydraulic directional control valve belonging to a first one of the hydraulic directional control valve sets is supplied to the actuator, but when the first actuator is to operate at a high speed, pressure oil from another hydraulic directional control valve belonging to the other or second hydraulic directional control valve set is joined to the pressure oil from the hydraulic directional control valve belonging to the first hydraulic directional control valve set and is supplied to the actuator. However, operating conditions of a hydraulic shovel are normally very complicated and it often occurs that it is desired, during operation of the first actuator at a high speed, to cause a second actuator connected to a hydraulic directional control valve belonging to the second hydraulic directional control valve set to operate at the same time and additionally to hold the relative operating speeds of the first and second actuators at a predetermined ratio in accordance with current operating conditions. However, various load pressures aıe required for the actuators, but the load pressures are restricted to an operating pressure of one of the actuators which presents a lower load pressure. Thus, the lower load pressure side actuator operates in a preceding relationship to the other actuator, and a starting requirement for the other actuator cannot be met. Accordingly, operability for a smooth composite operation cannot be obtained.

When a composite operation is performed wherein operating levers for the hydraulic directional control valves are caused to operate at the same time, the opening of a passage of the hydraulic directional control valve belonging to the first hydraulic directional control valve set upon changing over when the first actuator is to operate at a high speed is conventionally limited to a fixed value, or the amounts of operation of the operating levers are adjusted delicately, to cope with the condition described above.

This will be described below in connection with an example with reference to FIG. 3 which shows an oil hydraulic circuit for a common hydraulic shovel C shown in FIGS. 4 and 5. It is to be noted that the first actuator described above corresponds to a hydraulic cylinder 13 for lifting a working device and the second actuator corresponds to a hydraulic unit 14 for turning an upper turning body D.

The oil hydraulic circuit shown in FIG. 3 incudes a first hydraulic directional control valve set A which consists of hydrualic directional control valves 5, 6 and 7, a cut-off valve 11 and so forth. Pressure oil is supplied to the hydraulic directional control valve set A by way of a pipe line 18 from one of a pair of main pumps (not shown). The hydraulic directional control valve 5 is positioned on the most upstream side and is provided for exclusive use for an actuator for running. Thus, pressure oil is preferentially supplied to the hydraulic directional control valve 5. The hydraulic directional control valves 6 and 7 are located on the downstream side of the hydraulic directional control valve 5 and connected in a parallel circuit. The oil hydraulic circuit further includes another second hydraulic directional control valve set B consisting, similarly to the first hydraulic direction control valve set A described above, of hydraulic directional control valves 8, 9 and two-way throttling valve 20, a cut-off valve 12 and so forth. Pressure oil from the other main pump (not shown) is supplied to the second hydraulic directional control valve set B by way of another pipe line 19.

In the oil hydraulic circuit, when the hydraulic cylinder 13 normally called a boom cylinder for lifting a working device is to be extended, a pilot pressure of $P_{B1}$ is caused to act upon a pilot oil chamber 6*a* of the hydraulic directional control valve 6, and when a composite operation is to be performed wherein an upper turning body D is turned leftwardly or rightwardly at the same time with such lifting motion for the working device, the pilot pressure $P_{R1}$ is also caused to act upon a pilot oil chamber 14*a* or 14*b* of the hydraulic unit 14 for turning motion. However, when the value of the pilot pressure $P_{B1}$ is comparatively low, that is, when the working device is being lifted slowly, the two-way throttling for providing restrictive flow and for cutting-off flow valve 20 does not operate while maintaining its position G shown in FIG. 3, and only the hydraulic directional control valve 6 and the hydraulic unit 14 for turning motion operate. Thus, since pressure oil flows from the individually different hydraulic pressure sources are supplied individually to the hydraulic cylinder 13 and the hydraulic unit 14, they operate independently of each other. However, when the pressure of $P_{B1}$ is increased in order to expand the hydraulic cylinder 13 at a high speed, the two-way throttling valve 20 is simultaneously changed over from its G position to its H position. Consequently, pressure oil of the pipe line 19 flows not only to the hydraulic unit 14 for turning motion but also to the hydraulic cylinder 13 by way of an H position passage of the two-way throttling valve 20.

Consequently, the operating pressure of the pipe line 19 becomes equal to the pressure of one of the hydraulic cylinder 13 and the hydraulic unit 14 which is lower in load pressure than the other.

Generally , in such composite operation of the hydraulic shovel as described above, the pressure upon expansion of the hydraulic cylinder 13 is lower than a pressure required for the hydraulic unit 14 upon starting of the turning motion. Consequently, the latter pressure is limited by the former pressure, and the accelerating performance of the turning body D, that is, the rising characteristic, is deteriorated. Accordingly, the opening area of the H positon passage of the two-way throttling valve 20 is limited as illustrated in FIG. 3 to obtain a throttle effect so that the operating pressure upon the hydraulic unit 14 for turning motion may not become excessively low.

It is to be noted that the cut-off valves 11 and 12 may be required or not required depending upon various hydraulic circuits, but in the present example, when pressure oil from the two main pumps is joined together or else branched to utilize the pressure oil most reasonably in order to realize the linearity of running in a single operation or in a composite operation for running, for operation of the working device, for operation for turning motion or the like, and also realize the rapidity and the certainty of various operations, the cut-off valves 11 and 12 play a role of preventing such pressure oil from flowing out to a tank 21 in vain. However, illustration of an acting circuit for a signal pressure to the pilot oil chambers of the cut-off valves 11 and 21 is omitted in FIG. 3.

Here, a case wherein excavating and loading operations are performed with the hydraulic shovel C described above is described as an example. In particular, after an excavating operation is completed, the hydraulic cylinder 13 is expanded to lift the working device while at the same time the upper turning body D is turned until the working device comes to a suitable vertical postiton above a dump truck E where excavated earth and sand is discharged into the dump truck E. Such sequence of operations is repeated. In this instance, the opening of the H position passage of the two-way throttling valve 20 is determined such that pressure oil of the pipe line 19 may be distrubuted mainly so that expansion of the hydraulic cylinder 13 and operation of the hydraulic unit 14 may be performed at the same time and in addition the lifting height of the working device and a desired turning angle may be reached at the same time.

For example, when the upper turning body D is to be turned by about 90 degrees to perform loading in such an arrangement of the hydraulic shovel C and the dump truch E as shown in FIG. 4. if lifting of the working device and turning motion of the upper turning body D are started at the same time after completion of an excavating operation, then if it is assumed that the opening of the H position passage is fixed such that the vertical position of the working device and the turning angle of the upper turning body D may provide a best loading position with respect to the dump truck E, then in such a loading operation after turning motion of about 180 degrees as shown in FIG. 5, the turning angle is insufficient with respect to the lifting amount of the working device. On the contrary, if an optimum H position opening is provided in such an operation arrangement as shown in FIG. 5, then a disadvantage will take place in such an operation arrangement as shown in FIG. 4. Accordingly, the operating levers must be adjusted delicately each time, and therefore, very high skill is required for rapid and smooth excavating and loading operations.

SUMMARY OF THE INVENTION

It is an object of the present invention to provide an oil hydraulic circuit with which, in a composite operation wherein operating levers for lifting motion of a working device and for turning motion are operated at the same time in accordance with various operating conditions, desired relative speeds can be obtained readily and even an unskilled operator can make an accurate and rapid running operation.

In order to attain the object described above, according to the present invention, there is provided an oil hydraulic circuit for a hydraulic shovel which includes a pair of hydraulic directional control valve sets each adapted to receive supply of pressure oil from an individual main pump, which comprises a first actuator which operates at a low speed with pressure oil from a hydraulic directional control valve belonging to one of the hydraulic directional control valve sets and which operates with pressure oil from the hydraulic directional control valve belonging to the one hydraulic directional control valve set and also from another hydraulic directional control valve belonging to the other hydraulic directional control valve set, a second actuator which operates only with pressure oil from a hydraulic directional control valve belonging to the other hydraulic directional contol valve set, a proportional changing over means interposed intermediately in a pipe line communicating the other hydraulic directional control valve set with the first actuator for adjusting the maximum meter-in opening value to the first actuator in response to a magnitude of a signal received at a signal receiving portion of the proportional changing over means, and a controller for arbitrarily adjusting the signal to be supplied to the signal receiving portion of the proportional changing over means.

Preferably, the controller is provided in the neighborhood of an operator's seat in a cage of the hydraulic shovel.

The oil hydraulic circuit may further comprise a proportional signal converting device for converting a signal from the controller into a signal in the form of a hydraulic pressure.

With the oil hydraulic circuit, if the pressure necessary for the second actuator is insufficient and if the first actuator is caused to operate at a high speed and the second actuator is caused to operate at the same time in a composite manner, then the controller in the neighborhood of the operator's seat is operated so as to supply a signal to the signal receiving portion of the proportional changing over emeans to decrease the maximum meter-in opening value of the proportional changing over means. Consequently, pressure oil to be supplied to the second actuator is limited from flowing out at a low pressure to the first actuator. Accordingly, in such a composite operation as described above, if the controller is adjusted suitably, then the first actuator and the second actuator can be caused to arbitrarily operate with suitable flowing in amounts of oil and under suitable hydraulic pressures in accordance with various working conditions. Further, even in the case of a composite operation in various working conditions, only if the controller is adjusted suitably, then smooth and rapid operation can be attained without requiring a specially delicate lever operation, which is safe and efficient even to an unskilled operator.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
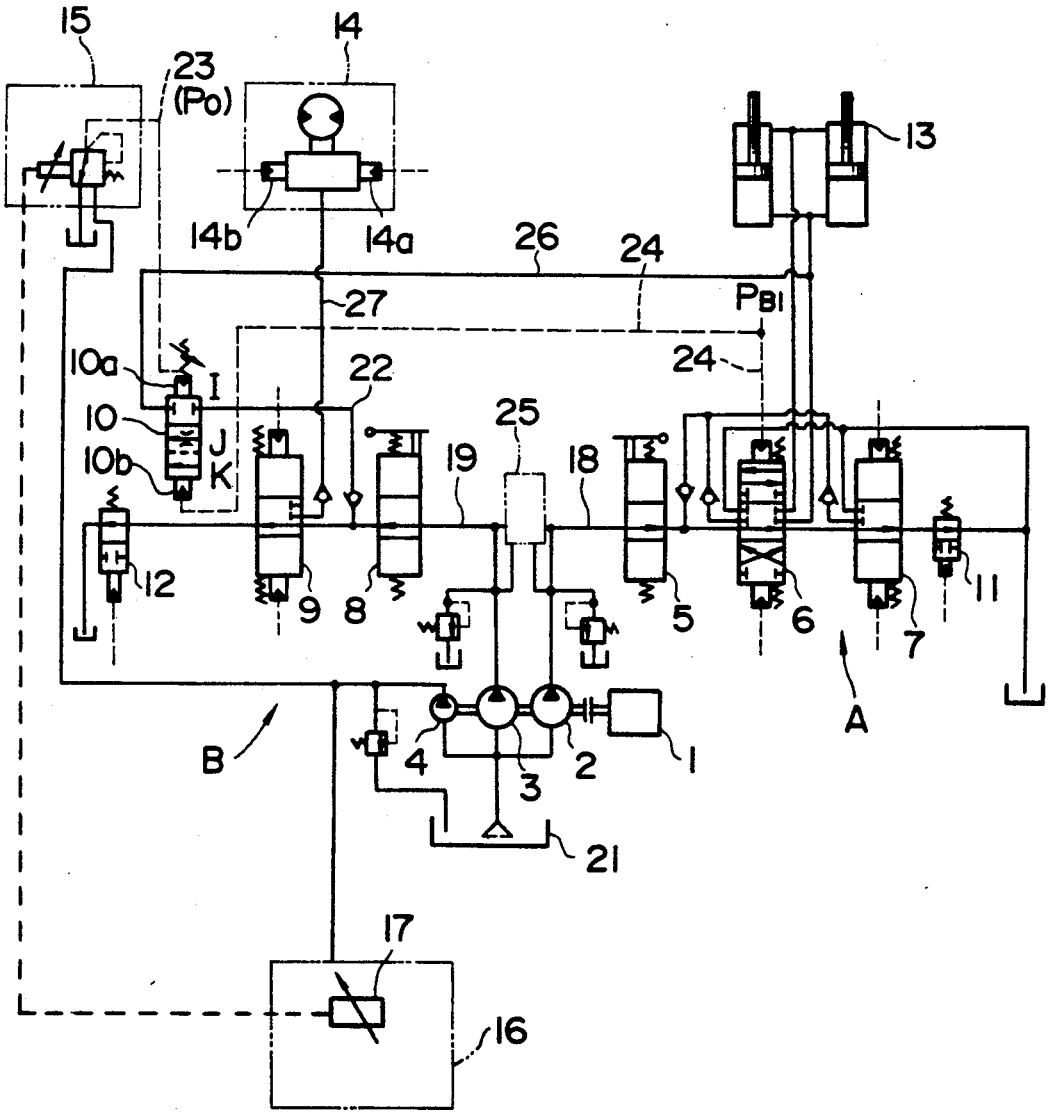
FIG. 1 is a hydraulic circuit diagram of a hydraulic shovel which incorporates an oil hydraulic circuit according to the present invention.
Figure 3:
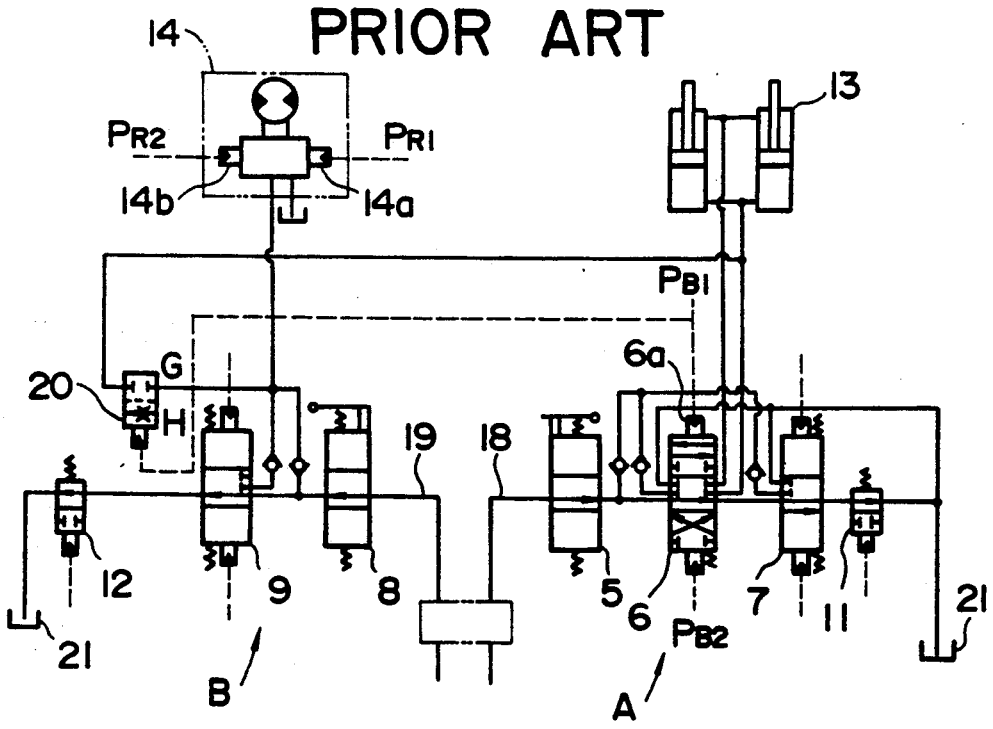
FIG. 3 PRIOR ART
FIG. 3 is a hydraulic circuit diagram of a conventional hydraulic shovel.

Referring to FIG. 1, there is shown an oil hydraulic circuit for a hydraulic shovel according to the present invention. The oil hydraulic circuit shown includes a main pump 2 serving as a hydraulic pressure source for a hydraulic directional control valve set A, another main pump 3 serving as a hydraulic pressure source for another hydraulic directional control valve set B and a pilot pump 4 serving as a hydraulic pressure source for a signal and some other operating systems. The main pumps 2 and 3 and the pilot pump 4 are connected to be driven by an engine 1. It is to be noted that the oil hydraulic circuit has generally common construction to the oil hydraulic circuit shown in FIG. 3. Thus, like parts to those of FIG. 3 are denoted by like reference characters in FIG. 1, and overlapping description of common components to them is omitted herein to avoid redundancy.

The oil hydraulic circuit includes, in place of the hydraulic directional control valve 20 of the oil hydraulic circuit shown in FIG. 3, a proportional three-position valve 10 for selectively communicating, restricting and cutting off flow, hereinafter referred to as a proportional three-position valve 10 interposed between a pair of pipe lines 22 and 26 which allow discharge pressure oil of the main pump 3 to flow, when a cut-off valve 12 is closed, from the downstream side of a hydraulic directional control valve 8 for running to an expansion side oil chamber of a hydraulic cylinder 13 by way of a chech valve. The proportional three-position valve 10 has a pair of pilot oil chambers 10*a* and 10*b* for operating the valve 10 in the opposite directions to each other. The proportional three-position valve 10 is normally held by an urging force fo a spring at an I position at which it disconnects the pipe lines 22 and 26 from each other. However, if such a high signal pressure $P_{PI}$ that may expand the hydraulic cylinder 13 (called boom cylinder) for lifting a working device at a high speed acts upon the pilot oil chamber 10*b*, then the valve 10 is change over from the I position to a K position against the urging force of the spring so that the pipe lines 22 and 26 are fully communicated with each other.

Figure 2:
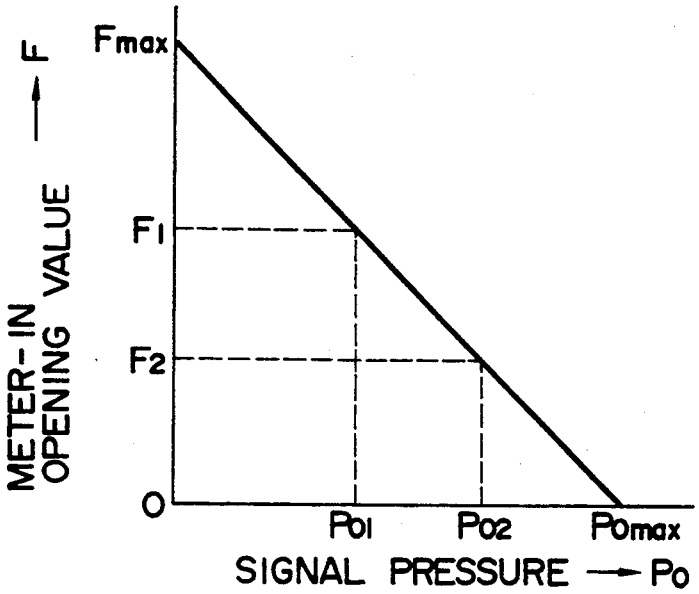
FIG. 2 is a diagram illustrating a characteristic of a proportional directional control valve of the oil hydraulic circuit shown in FIG. 1.

In the condition, if a signal pressure Po of a pilot pipe line 23 acts upon the pilot oil chamber 10*a*, then the acting force operates the proportional three-position valve 10 in proportion to the magnitude of Po against the acting force of $P_{BI}$ acting upon the pilot oil chamber 10*b* to limit the maximum value of the meter-in opening of the proportional three-position valve 10 by way of which the pipe line 22 and 26 are communicated with each other. Consequently, the proportional directional control valve 10 may be changed over from the K position to a J position or further to the I position. Such characteristic of the proportional three-position valve 10 will be described with reference to FIG. 2. In FIG. 2, the axis of abscissa indicates a signal pressure Po of the pilot pipe line 23 while the axis of ordinate indicates a meter-in opening value F of the valve 10. It can be seen from FIG. 2 that the proportional three-position valve 10 has such a characteristic that, when the signal pressure Po is 0 in a condition wherein a sufficiently high signal pressure of $P_{BI}$ acts upon the pilot oil chamber 10*b*, the meter-in opening value F presents its maximum value of $F_{MAX}$, that is, the proportional three-position valve 10 of FIG. 1 is positioned at the K position, but as the signal pressure Po increases to $Po_1$, $Po_2$ and further to $Po_{MAX}$, then the meter-in opening value F decreases in a proportional relationship to $F_1$, $F_2$ and further to 0, respectively.

The oil hydraulic circuit further includes a proportional signal converting device 15 which converts, in accordance with an electric signal received from a controller 17, a prescribed pressure of pressure oil supplied from the pilot pump 4 into a necessary signal pressure of 0, $Po_1$, $Po_2$, $Po_{MAX}$ or the like, which is transmitted to the pilot pipe line 23. The controller 17 is disposed in a cage 16 of the hydraulic shovel so that it may be adjusted readily by an operator while the operator remains in a seated condition in the cage 16. The controller 17 is constructed such that it may be adjusted by an operator and delivers an electric signal in accordance with such adjustment thereof.

The oil hydraulic circuit further includes a rectilinear running valve 25 of the type which is often provided in an oil hydraulic circuit of a conventional hydraulic shovel of the crawler type. The rectilinear running valve 25 plays a role for a rectilinear running action of the hydraulic shovel and also some other roles in cooperation with the cut-off valves 11, 12 and so forth. However, details thereof is omitted herein because there is no direct relation to the present invention.

Operation of the present invention having such a construction as described above will be described.

Figure 4:
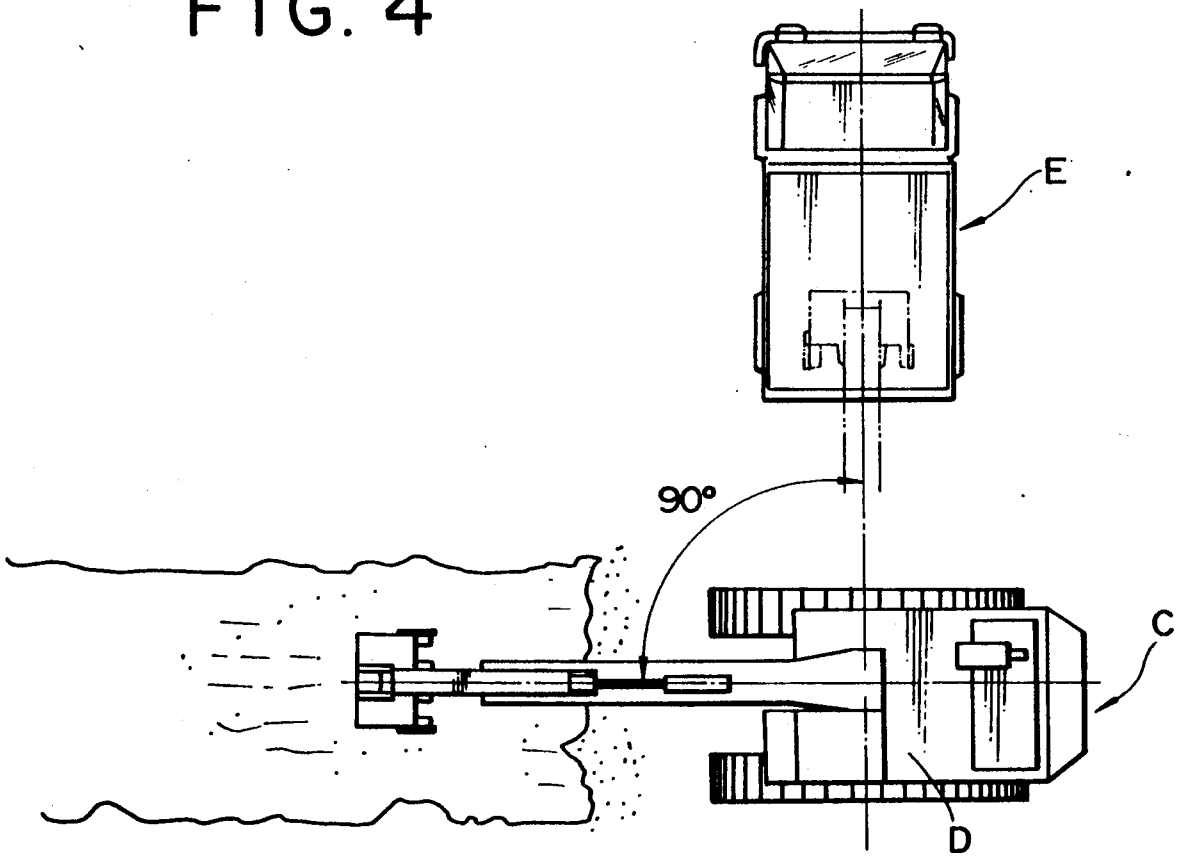
FIGS. 4 and 5 are plan view illustrating situations when an upper turning body is turned by 90 degrees and 180 degrees, respectively, to perform loading into a dump truck using a back hoe.

Such a back hoe working operation with the hydraulic shovel C as shown in FIG. 4 involves a turning motion, after an excavating operation, of the upper turning body D by 90 degrees to load earth and sand into the dump truck E as described above. In order to perform such an operation, the controller 17 within the cage 16 is first adjusted. Then, in order to perform a composite operation, an operating lever for lifting motion is operated to a position at which the signal $P_{BI}$ for operation to expand the hydraulic cylinder 13 presents its maximum value, that is, the working device is lifted at a high speed while another operating lever for turning motion is operated to a position at which the hydraulic unit 14 for turning motion is operated. Since the signal pressure Po within the pilot pipe line 23 then presents an intermediate value such as, for example, $Po_1$ shown in FIG. 2 due to an action of the proportional signal converting device 15, the meter-in opening value of the proportional three-position valve 10 then is reduced to $F_1$ as compared with the case wherein the meter-in opening value is equal to $F_{MAX}$ so that a throttle effect is provided to the passage which communicates the pipe line 22 to the pipe line 26. Consequently, part of pressure oil from the pipe line 19 is throttled and then passes through the pipe line 26, whereafter it joins with pressure oil from the pipe line 18 in the same pressure condition and then flows into the hydraulic cylinder 13. Meanwhile, the remaining pressure oil of the pipe line 19 presents a pressure higher than the pressure within the pipe line 26 and passes through the pipe line 27 as it is so that it operates the hydraulic unit 14 for turning motion. Accordingly, while generally the load pressure of the hydraulic cylinder 13 which is an actuator for lifting the working device is low and the load pressure upon starting of the hydraulic pressure for turning motion which is an actuator for operation of the upper turning body D is high, pressure oil of the pipe lines 19 and 22 will not flow in a one-sided manner only into the pipe line 26 but will flow into the hydraulic unit 14 for turning motion with a pressure with which a suitable starting force is provided to the hydraulic unit 14 for turning motion. Accordingly, only if the controller 17 is adjusted suitably, then when the upper turning body D is turned by about 90 degrees, the working device is lifted to a desired vertical position suitable for loading into the dump truck E.

Figure 5:
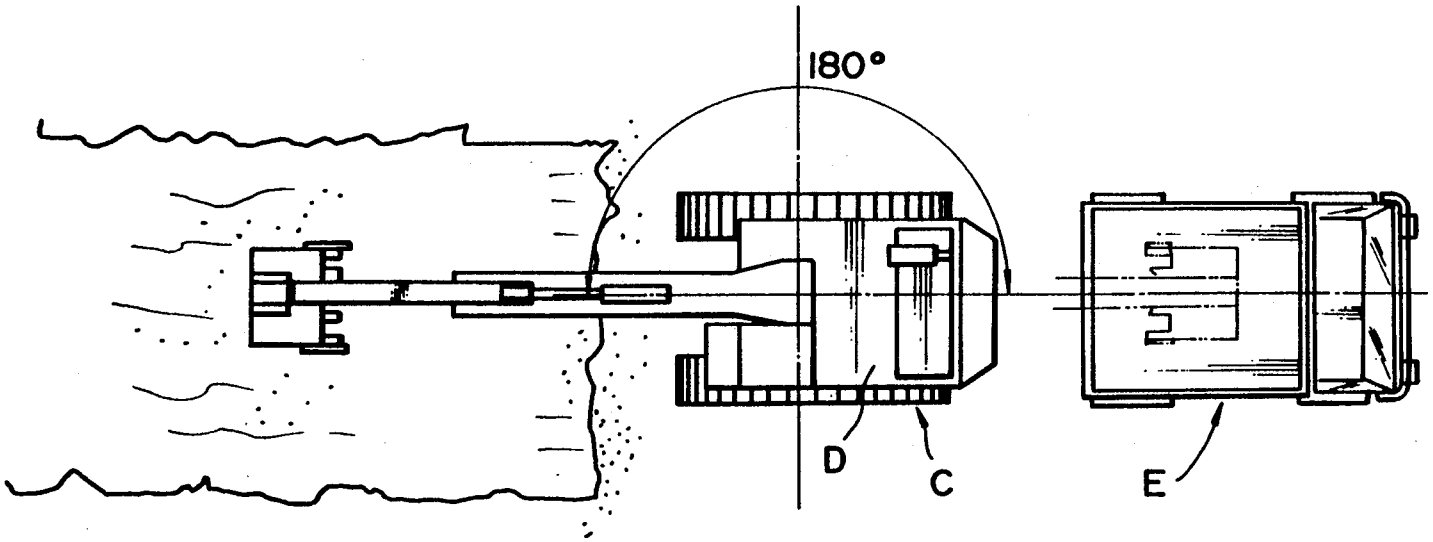

Depending upon working conditions, sometimes it cannot be avoided to dispose the dump truck E rearwardly of the hydraulic shovel C as shown in FIG. 5 and turn the upper turning body D by 180 degrees to load earth and sand into the dump truck E. Also in such an instance, if it is assumed that a composite operation of lifting of the working device and turning motion of the upper turning body D is performed after completion of an excavating operation while the setting for the operation shown in FIG. 4 is maintained, then the turning angle will be about 180 degrees and hence twice that of the case described above, and the lifting height of the working device will also be twice. Accordingly, either the working device must be suitable lowered after such turning motion, or operation of the operating lever for the working device must be adjusted during turning motion. Accordingly, it is a matter of course that, if it is intended to make a smooth and rapid operation in this distance, considerable skill is required.

In order to cope with the foregoing, in the oil hydraulic circuit of the present invention, the meter-in opening value of the proportional three-position valve 10 is changed from $F_1$ $F_2$ by adjusting the controller 17 so as to change the signal pressure Po obtained from the proportional signal converting device 15, for example, to a higher pressure, for example, from $Po_1$ to $Po_2$ of FIG. 2. Consequently, the throttle effect of the flowing in passage from the pipe line 22 to the pipe line 26 is raised so that not only the amount of flowing in oil from the pipe line 22 to the pipe line 26 presents a decreasing tendency but also the pressure difference between the pipe lines 22 and 26 is increased compared with that of the case described hereinabove. As a result, the starting performance of the hydraulic unit 14 for turning motion is improved, and the amount of oil flowing in is increased. Consequently, turning motion of the upper turning body D proceeds by a greater amount with respect to lifting motion so that, when the upper turning body is turned by about 180 degrees, the working device comes to a vertical position suitable for loading of earth and sand into the dump truck E.

Such a sequence circuit that will not allow the signal pressure Po to start an action of limiting the meter-in opening value of the proportional three-position valve 10 until after a signal $P_{B1}$ for operation of expanding the hydraulic cylinder 13 at a high speed and a signal for operation of the hydraulic unit 14 for turning motion are produced at the same time irrespective of an adjusted position of the controller 17 may be provided between the controller 17 and the proportional signal converting device 15 or between the proportional signal converting device 15 and a signal receiving portion of the proportional three-position valve 10. Where such sequence circuit is provided, in an ordinary single operation, no throttle effect will take place at the connecting passage from the pipe line 22 to the pipe line 26, and consequently, the hydraulic cylinder 13 can be caused to operate at a high speed.

While the foregoing example of operation relates to the hydraulic shovel which performs turning motion of 90 degrees and 180 degrees to perform loading by means of a back hoe attachment, working of a hydraulic shovel originally involves not only excavation and loading of earth and sand but also various repetitive workings such as up and down movement of a working device and movement of an object for working by turning motion with various attachments mounted thereon. Accordingly, the controller 17 is adjusted infinitely in accordance with a required amount of movement and a relative required speed to change the signal pressure Po of the pilot pipe line 23 within a range from 0 to $Po_{MAX}$ in order to attain the object.

It is to be noted that, while, in the present embodiment, electricity is employed as a signal medium between the controller 17 provided in the cage 16 and the proportional signal converting device 15 and a hydraulic pressure is used as a signal medium to the pilot oil chamber 10*a* of the proportional three-position valve 10 such that an instruction signal from the controller 17 may be converted by the proportional signal converting device 15 in order to adjust the maximum value of the meter-in opening of the proportional three-position valve 10, the present invention is not necessarily limited to the specific embodiment. Thus, the signal medium may be, in addition to such electricity the hydraulic pressure described above, a pneumatic pressure or a mechanical link or a combination of them or a single one of them. Or else, an output of a controller which develops an arbitrarily adjustable signal may be supplied directly to a signal receiving portion of such a proportional changing over means having a function of adjusting the maximum value of a meter-in opening in accordance with a magnitude of a signal from the outside as the proportional three-position valve 10.

Having now fully described the invention, it will be apparent to one of ordinary skill in the art that many changes and modifications can be made thereto without departing from the spirit and scope of the invention as set forth herein.

What is claimed is:

1. An oil hydraulic circuit for a hydraulic shovel comprising:

first and second hydraulic directional control valve sets, each of said first and second hydraulic directional control valve sets being adapted to receive a supply of pressure oil from first and second individual main pumps;

a first actuator which operates at a low speed with pressure oil from a first hydraulic directional control valve belonging to one of said first and second hydraulic directional control valve sets and which operates with pressure oil from said first hydraulic directional control valve belonging to said one of said first and second hydraulic directional control valve sets and also from a second hydraulic directional control valve belonging to the other of said first and second hydraulic directional control valve sets;

a second actuator which operates only with pressure oil from said second hydraulic directional control valve belonging to said other of said first and second hydraulic directional control valve sets;

a proportional changing over means having a signal receiving portion, said proportional changing over means being interposed intermediately in a pipe line communicating said other of said first and second hydraulic directional control valve sets with said first actuator for selectively communicating, throttling and cutting off fluid flow to said first actuator for adjusting a maximum meter-in opening value to said first actuator in response to a magnitude of a signal received at said signal receiving portion of said proportional changing over means; and a controller for arbitrarily adjusting the signal to be supplied to said signal receiving portion of said proportional changing over means.

2. An oil hydraulic circuit for a hydraulic shovel according to claim 1, wherein said controller is provided in the neighborhood of an operator's seat in a cage of said hydraulic shovel.

3. An oil hydraulic circuit for a hydraulic shovel according to claim 1, further comprising a proportional signal converting device for converting said signal from said controller into a signal in the form of a hydraulic pressure.

* * * * *